United States Patent [19]

Staudenmayer et al.

[11] 4,035,750

[45] July 12, 1977

[54] ELECTROPHOTOGRAPHIC APPARATUS HAVING IMPROVED PHOTOCONDUCTOR REGENERATIVE STRUCTURE AND PROCEDURE

[75] Inventors: William J. Staudenmayer, Pittsford; Curtis L. Stephens; John R. Thompson, both of Rochester, all of N.Y.

[73] Assignee: Eastman Kodak Company, Rochester, N.Y.

[21] Appl. No.: 621,913

[22] Filed: Oct. 14, 1975

[51] Int. Cl.[2] ..... G03G 15/00

[52] U.S. Cl. ..... 355/3 R; 96/1 R; 355/15

[58] Field of Search ..... 355/3 R, 15, 16; 96/1 R, 1.8

[56] References Cited

U.S. PATENT DOCUMENTS

| | | | |
|---|---|---|---|
| 2,968,553 | 1/1961 | Gundlach | 355/3 R |
| 3,190,198 | 6/1965 | Eichorn | 355/3 R |
| 3,504,969 | 4/1970 | Martel | 355/3 R |
| 3,904,407 | 9/1975 | Regensburger et al. | 96/1 R |
| 3,910,697 | 10/1975 | Lanker | 355/3 R |
| 3,914,047 | 10/1975 | Hunt et al. | 355/16 |

FOREIGN PATENT DOCUMENTS

| | | | |
|---|---|---|---|
| 867,668 | 5/1961 | United Kingdom | 96/1 R |

*Primary Examiner*—L. T. Hix
*Assistant Examiner*—J. A. LaBarre
*Attorney, Agent, or Firm*—John D. Husser

[57] ABSTRACT

An electrophotographic apparatus having improved structure and procedures for regenerating electrophotosensitive properties of its photoconductive imaging member. Erase lights, of spectral quality matching peak absorption characteristics of the imaging member, are located to enable their radiation to be strongly absorbed proximate the positively biased surface of the imaging member. The regenerative sources are provided at locations around the copying path which cause relief of field load on the photoconductor during each cycle, soon after its useful function has been accomplished.

13 Claims, 8 Drawing Figures

ELECTROPHOTOGRAPHIC APPARATUS HAVING IMPROVED PHOTOCONDUCTOR REGENERATIVE STRUCTURE AND PROCEDURE

BACKGROUND OF INVENTION

1. Field of Invention

The present invention relates to improved electrophotographic apparatus and method for controlling electrical memory effects in reusable photoconductive members. More specifically the invention relates to apparatus and techniques for substantially reducing a form of electrical fatigue, occurring in such films, which causes a "residual image" of a previously copied document in subsequent copies of another document.

2. Description of Prior Art

The residual image phenomenon, noted above, is observed as a faint image of a previous document in initial copies of a new document after the previous document has been repeatedly imaged on the reusable photoconductive insulator member, i.e., after that member has been cyclically charged overall and discharged, repeatedly in registry, by the light pattern from the previous document. This residual image effect is believed to be caused by the accumulation of electrons trapped within the volume of the photoconductor in imagewise pattern corresponding to the dark portion of the previous document image. The speed (rate of discharge per unit exposure) of the photoconductor is decreased by this accumulation of trapped electrons so that, upon exposure to a new document, the area of the photoconductive member associated with the previous document pattern is discharged less than other photoconductor portions and is developed with toner as a background image. It will be readily appreciated that such a background image is detractive from the esthetic viewpoint; however, the provision of previous document information in the subsequent document copies presents an even more serious problem when proprietary information is embodied in the previous document.

It is well known that fatigue of the type causing the residual image effect in photoconductive insulator members can be relieved to some extent by application of infrared radiation to, or otherwise heating, such members or by an overall flooding of such members with light (see for example U.S. Pat. No. 2,863,767 and *Electrophotography* by R. M. Schaffert, 2nd Edition, 1966, page 87). Also, it has been noted that some regeneration of such a fatigued member can be effected by application of an electrostatic charge, of polarity opposite that of the primary (sensitizing) charge, at some time after the development step and before any subsequent sensitizing step of a copy cycle (see for example U.S. Pat. No. 2,741,959). However, in certain electrophotographic apparatus, e.g., a high speed copier/duplicator, in which a photoconductive insulator member is rapidly exposed a large number of times to the same image, the residual image problem is more pronounced; and the above-noted prior art techniques have been found impractical and/or to inadequately eliminate residual image, at least in certain such members.

SUMMARY OF INVENTION

It is therefore an object of the present invention to provide improved apparatus and procedures for controlling electrical memory effects in photoconductive insulator members.

It is another, more specific, object of the present invention to control such effects to eliminate residual images in such members.

Still another object of the present invention is to provide improved electrophotographic apparatus having means for minimizing trapped electrons within its reusable photoconductive insulative member and improve means for neutralizing electrons which do become trapped within such member.

These objectives are accomplished, in accordance with the present invention, by provision of means for promptly relieving the field load on the photoconductive insulator member at appropriate stages in the copy cycle and by more effective means for flowing positive holes into the member to neutralize trapped electrons within the volume. More specifically, the invention provides for subjecting the positively biased surface of the photoconductive insulator member to sources of electromagnetic radiation of wavelength specifically selected to be strongly absorbed at that positively biased boundary. Further, the location of the means for providing such radiation advantageously is determined to relieve field load on the member soon after the useful function associated with the field load is completed. A particularly advantageous embodiment of the present invention involves exposure of an organic photoconductive insulator member, which operates with a negative polarity primary charge, from the rear through a transparent support and conductive layer, the exposure being with light with a spectral quality which is chosen to be strongly absorbed in a small zone immediately proximate the positively biased conductive layer-interface with the member.

DESCRIPTION OF DRAWINGS

Further objectives and advantages of the present invention will be apparent from the subsequent detailed description of preferred embodiments of the present invention, with reference to the accompanying drawings in which like numerals denote like elements and wherein.

DETAILED DESCRIPTION OF PREFERRED EMBODIMENTS

Figure 1:
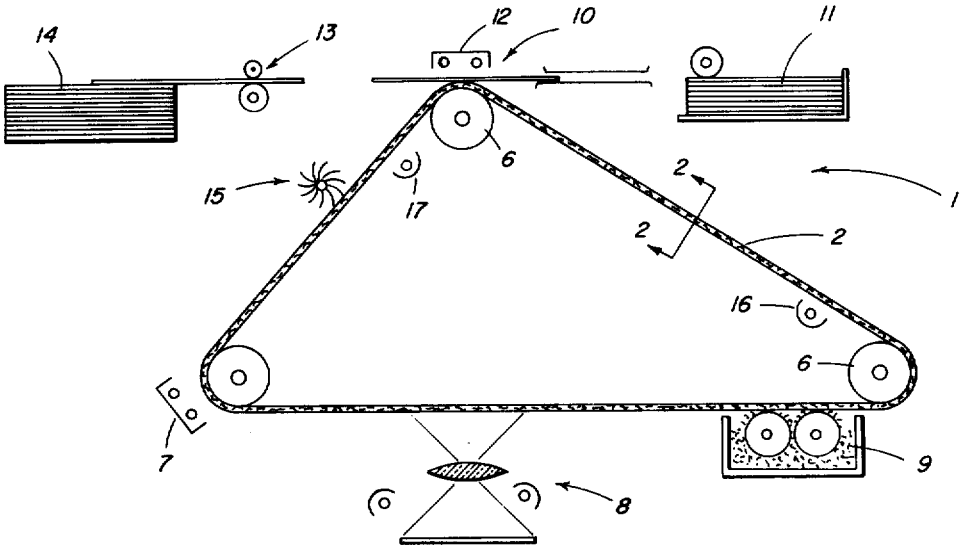
FIG. 1 is a schematic representation of one embodiment of an electrophotographic device incorporating residual image control apparatus in accordance with the present invention.
Figure 2:
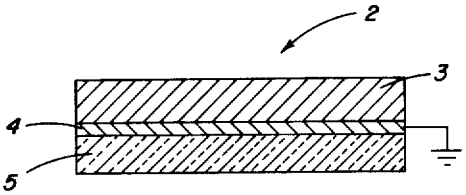
FIG. 2 is an enlarged cross-section of the flexible imaging web in FIG. 1.

In FIG. 1, the electrophotographic apparatus 1 comprises a flexible imaging member 2 configured for movement around an endless path past various operative stations of the apparatus. As can be seen more clearly in FIG. 2, the imaging member 2 includes a photoconductive insulating layer 3 overlying a thin, transparent, electrically-conductive layer 4 both supported on a transparent film 5. The conductive layer 4 is electrically connected to ground or other selected reference potential source by edge contact with rollers 6 of the apparatus 2 or by other techniques known in the art.

Operative stations of the apparatus 1 include a primary charging station at which corona discharge device 7 applies an overall charge to external surface of photoconductive insulating layer 3. After receiving the primary charge, an image segment of the member 2 advances past the exposure station 8 where the segment is imagewise exposed to light patterns of a document to be copied by Xenon lamps or other known imaging apparatus. The latent electrostatic image then residing on the segment is next advanced over a magnetic brush or other known development station 9 where toner is attracted to the charge pattern corresponding to dark image areas of the document. The developed image is then advanced to a transfer station 10 where the toner image is transferred to paper, fed from supply 11, by corona discharge device 12.

The paper bearing the toner image is then transported through a fixing station 13 (for example a roller fusing device) to a bin 14. The segment from which the toner is transferred meanwhile advances past a cleaning station 15 in preparation for another copy cycle. Light sources 16 and 17 are constructed and located in accordance with the present invention to illuminate the imaging member from the rear (through transporting film 5) in a manner which will subsequently be described in more detail. If desired an A.C. corona charger can be provided downstream from the transfer corona to assist detaching of the paper from the photoconductor and immediately proximate cleaning station 15 to assist in removal of residual toner.

Figure 3:
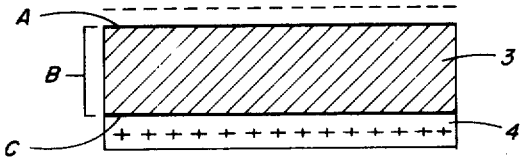
FIG. 3 is a schematic representation of a portion of the imaging web shown in FIG. 2, illustrating the photoconductive insulator layer in a non-fatigued condition.

Referring now to FIG. 3 the photoconductive insulating layer 3 is schematically illustrated in a rested, i.e., fully dark-adapted and non-fatigued, condition and with a uniform primary charge of negative polarity on the surface thereof separated from the volume or bulk B of the layer by the surface or barrier portion A of the layer. It can be seen that corresponding positive charges are induced in the conducting layer 4 and are blocked from passing into the volume of the layer by the interface portion C of layer 3. As illustrated, the non-fatigued layer has no trapped electrons or holes within its volume B; however, in accordance with one hypothesis, trapped holes (positive charges) exist in the volume B proximate the interface layer in the normal condition and substantial equilibrium of hole injection from conductor 4 and release of holes from the traps exists after primary charging is completed and initial charge decay terminates. Since the trapped holes discussed above involve only normal dynamics in the charging of the photoconductive insulating layer and are released readily during imagewise exposure of the photoconductor, they are not shown or further discussed.

Figure 4:
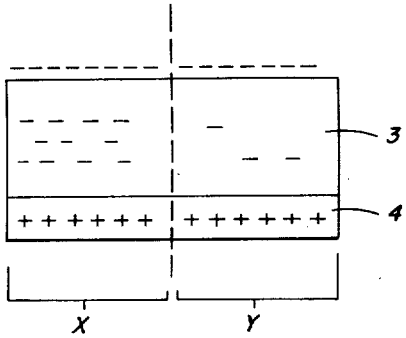
FIG. 4 is an enlarged representation of a portion of the layer of FIG. 2, illustrating the fatigued condition of such layer.

The problem with which the present invention is concerned is the trapping of electrons deep within the volume of the photoconductive insulating layer. This condition is created as a result of large field load on the layer, field load being the product of surface charge borne by the layer and the time such charge is allowed to exist. In instances where a given document is repeatedly copied in registry on the imaging element, the portion of the element corresponding to dark document portion carries a high charge potential substantially longer than portions corresponding to light document areas. The result of such repeated copying of a single document is schematically represented in FIG. 4 where the volume above zone X corresponds to a dark document portion (having been subjected to a high field load) and volume above zone Y corresponds to a light document portion (subjected to a lower field load). As is illustrated, substantially more trapped electrons exist in the zone X volume. Upon subsequent primary charging and imagewise exposure to a different light pattern the differential of trapped electrons creates a difference in the rate of primary charge dissipation by the photoconductor portions overlying zones X and Y. Thus in the latent electrostatic image of a new document, a differential residual charge will exist between similarly exposed (equal time and intensity) portions of zone X versus zone Y, causing a background image on one zone (i.e., the previous document image) to be visible on the copy of the new document after development and transfer.

As indicated previously, prior art techniques have attempted to effectively neutralize the deep-trapped electrons by (1) heating the photoconductor to create electron hole pairs; (2) applying a charge of polarity opposite the primary charge on the image surface to migrate towards the electrons and (3) exposing the layer to penetrating illumination to create electron-hole pairs throughout the volume.

Figure 5:
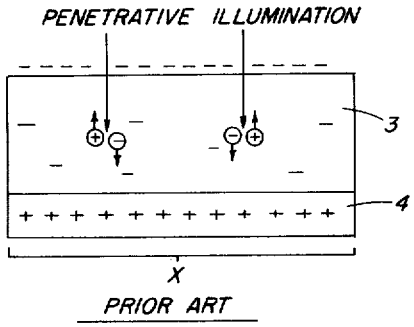
FIG. 5 is a representation of a fatigued portion of the layer of FIG. 2, under application of penetrative illumination as practiced in accordance with prior art techniques.

The last mentioned prior art techniques are more closely related to the present invention and are schematically illustrated in FIG. 5. However, an efficiency exists in such prior art illuminating techniques. Specifically, although the penetrative illumination creates free holes within the volume capable of neutralizing the trapped electrons, free electrons are also created deep within the volume. Some of the newly created free electrons will migrate successfully to the interface with the positively biased conducting layer; however, others will be trapped within the volume of the layer. Also it can be seen that if a neutralizing hole is created within the volume, its migration path toward the negatively biased surface does not transverse the entire volume, lessening the probability of its encountering and neutralizing a trapped electron.

Figure 6:
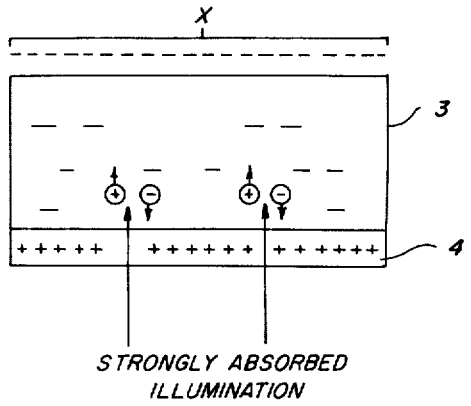
FIG. 6 is a representation similar to FIG. 5 but illustrating the layer under application of strongly absorbed illumination in accordance with the present invention.

One aspect of the improved erase illumination technique of the present invention avoids the problems of the FIG. 5 techniques and is schematically illustrated in FIG. 6. In accordance with this procedure, the photoconductive insulating layer is exposed at its positively biased surface to electromagnetic radiation comprising, in substantial proportion, wavelengths in the peak absorption range of the photoconductive insulating layer. Assuming a negative primary charge as shown in FIG. 6, the interface with the positive polarity conductive layer would be so exposed. Viewing the representation in FIG. 6, two advantages of this technique over prior devices, become apparent. First, a large portion of the newly created electron-hole pairs are located proximate the positively biased interface so that such newly created electrons are prevented from moving into, and becoming trapped in, the volume of the layer. Secondly, the newly created holes flow through the substantially entire thickness of the volume increasing the likelihood of a neutralizing encounter with trapped electrons.

Referring back to FIG. 1, one preferred apparatus for implementing this technique can now be described. In particular sources 16 and 17 are selected to emit radiation which is "strongly absorbed" by the photoconductive insulating layer 3. Also, it can be seen that, in this embodiment, the sources are located on the opposite side of imaging element 2 from the photoconductive insulating layer to expose the rear surface, which is proper in accordance with the invention for a system utilizing a primary charge of negative polarity. The radiation from sources 16 and 17 passes through the transparent support and substantially transparent conducting layer and is absorbed in large proportion by portions of the photoconductive insulating layer closely proximate the positively biased interface portion of the layer 3. It will be appreciated, that the implementation of the invention with an imaging element utilizing a positive primary charge would involve exposing the front, instead of the rear, of the imaging layers with the appropriate wavelength radiation.

Considering the foregoing explanation, it can be understood that the operative mechanism of the invention described depends critically on the selection of an appropriate source of regenerative or "erase" radiation; that is, the wavelengths of radiation utilized to expose the positively biased surface must be matched to the peak radiation absorption characteristics of the particular photoconductive insulating layer utilized. For example, when using photoconductive insulating layers comprising aggregate organic photoconductors of the type described in U.S. Pat. No. 3,615,414, which have their absorption maxima in the red light range, i.e., about 610 to 710 nm, regenerative sources that provide radiation of wavelengths in the red light range and that have a large portion of their spectral content of wavelength closely corresponding to the peak absorption wavelength(s) of the particular photoconductor are useful in accordance with the present invention. Similarly, organic photoconductive compositions of the type described in Example 2B of U.S. Pat. No. 3,873,311 have absorption maxima in the white light range (400 to 740 nm) and therefore regenerative sources comprising radiation in that wavelength range with a large portion of their spectral content of wavelength closely corresponding to the peak absorption wavelength(s) of the particular photoconductor are useful with such an element in accordance with the present invention.

More particularly analyses of the results of the above-described regenerative effect of particular spectral quality light with particular photoconductors indicate that, for a specific photoconductor, useful results in accordance with the present invention can be obtained by selection of a regenerative radiation source to include the wavelength(s) maximumly absorbed by the photoconductor and from which at least 25% of the erase light energy incident on the photoconductive insulating layer's positively biased surface occurs at wavelengths to which the imaging member's net optical density is no less than about 50% of the member's maximum net optical density, i.e., its net optical density at maximally absorbed wavelength(s), (net optical density being the member's total optical density minus the optical density of its conductive layer and support). Radiation which has the above-described characteristics with respect to a particular photoconductor is referred to herein as being "strongly absorbed" by that photoconductor. That is, the term "strongly absorbed", as used in this specification and the claims with respect to the relation between a photoconductor and erase light source, shall mean the relation defined above.

When the positively biased surface of the above-described organic photoconductors are subjected to strongly absorbed radiation from sources 17 and/or 16 as indicated in FIG. 1, that erase illumination affects the photoconductive layer to relieve fatigue in the manner described with respect to FIG. 6. It is preferred that the erase light be constructed so that wavelengths that would be highly penetrative and be absorbed throughout the volume of the photoconductor, not be emitted or be filtered out to avoid creating the problems described with respect to FIG. 5 of the drawings.

The following examples illustrate the improved control of electrical memory achieved in accordance with the present invention.

EXAMPLE 1

An organic photoconductive film of the type disclosed in U.S. Pat No. 3,615,414 was utilized in three simulated reproductive cycle arrangements which were identical except for the source of regenerative radiation utilized. More particularly the film tested comprised a multiphase aggregate photoconductor composition including a continuous phase including a solid solution of an organic photoconductor, i.e., 4,4′ bis-(diethylamino)-2,2′-dimethyltriphenylmethane, and an electrically insulating polymer binder phase, i.e., Lexan 145, polycarbonate sold by General Electric Corporation, having dispersed therein a discontinuous phase comprising a finely divided particulate co-crystalline complex of (i) at least one polymer having an alkylidene diarylene group in a recurring unit, i.e., Lexan 145 polycarbonate, and (ii) at least one pyrylium-type dye salt, i.e., 4-(4-dimethylaminophenyl)-2,6-diphenyl thiapyrylium fluoroborate.

The total element (photoconductive film, conductive layer and support) had optical densities (including its 0.4 optical density conductive layer) of 0.43 at 450 nm, 1.0 at 550 nm and 3.46 at 690 nm. The element was charged with a negative corona to a surface potential of −500 volts, exposed on its front surface to an original document with 400 to 630 nm light and erased with the different radiation sources according to the methods described below respectively during each of three 1500 cycle tests. The original document was maintained in close registration with the exposed area of the film so that the latent image pattern was created in the same location on the film. Development, transfer and cleaning operations were omitted during the above-described tests. At the end of each 1500 cycle test, the original document was removed and the same film portion was charged in the same manner and exposed with the same light source to a uniformly gray document. The latent image of this new document was developed and the toned image transferred to a copy sheet for inspection of residual images of the original document. In each of the three experiments two erase lights emitting the particular radiation content being tested were used, one positioned after the development location and a second one after the location for transfer of the toned image to a copy paper. In each instance the erase lights were located in a position where they exposed the back surface of the film.

The table below compares the residual images that were obtained in the above-described procedure with erase lights of various wavelength content.

| Erase Light Approximate Wavelength Range and Intensity Maximum | Residual Image |
|---|---|
| Green - 485 to 580 nm (525 nm) | Fairly strong (Positive appearing) |
| White - 400 to 750 nm (610 nm) | Moderate (Positive appearing) |
| Red - 625 to 750 nm (660 nm) | Very weak (Positive appearing) |

The above results illustrate the advantage of using an erase light with a spectral content such that the light is strongly absorbed at the positively biased surface of the photoconductive film. That is, the green light erase resulted in a fairly strong residual image with the photoconductor. The white light resulted in a moderate residual image with the photoconductor, while the red light, which is strongly absorbed with respect to the photoconductor used, resulted in a marked reduction in residual image level.

Figure 7:
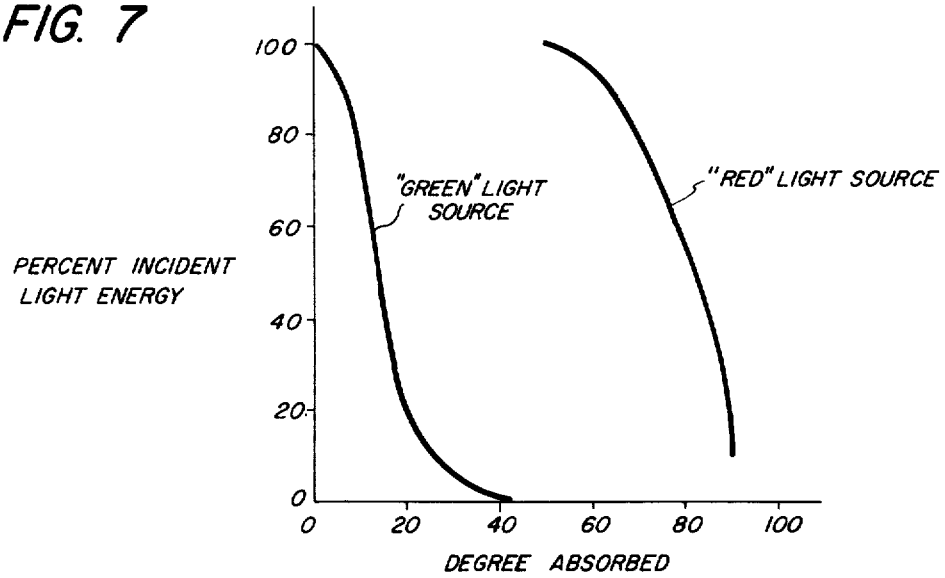
FIG. 7 is a graph showing the degree of absorption of particular light sources, used in Examples described in the specification, with a particular film.

FIG. 7 graphically illustrates the light to film absorption characteristics for the particular film and particular "red" and "green" light sources used in Example 1. In FIG. 7 the ordinate indicates the percentage of the total incident light from a particular source which has at least the degree of absorption denoted on the abscissa of the graph. It must be noted that the scale of the abscissa of the graph indicates a percentage representative of the ratio of net optical density of the film to given wavelengths of light to the net optical density of the film to its maximally absorbed wavelengths. Thus it can be seen from the graph of FIG. 7 that with respect to the film of Example 1, approximately 50% of the total incident light from the "red" light occurred at wavelengths to which the film's net optical density was no less than about 82% of the film's net optical density to its maximally absorbed wavelengths and about 99% of the total light incident from the red source occurred at wavelengths to which the film's net optical density was at least about 50% of its net optical density to maximally absorbed light. In comparison it can be seen also in FIG. 7, that with respect to the same film approximately 50% of the total incident light from the "green" light source of Example 1 occurred at wavelengths to which the film's net optical density was at least 15% of its net optical density to maximally absorbed light and that substantially none of the incident light from the green erase source ocurred at wavelengths to which the film had a net optical density 50% of its net optical density to maximally absorbed light.

Figure 8:
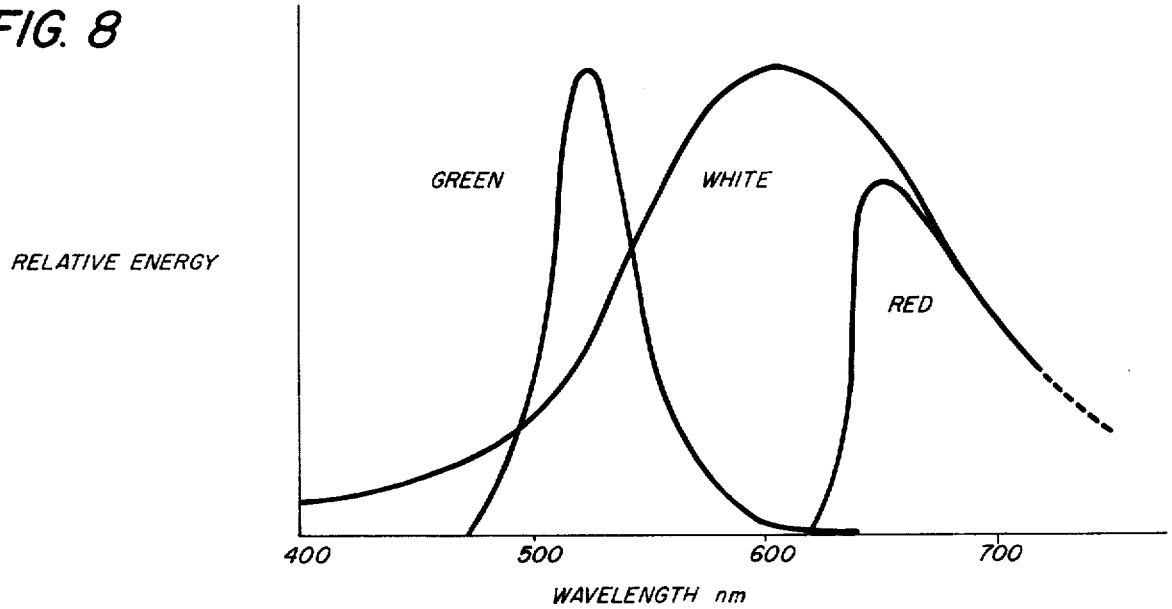
FIG. 8 is a graph showing the relative proportion of light at various wavelengths for various sources utilized in the Examples described in the specification.

FIG. 8 provides a graph illustrating the relative energy distribution at various wavelengths for each of the red, green and white light sources in Example 1. It must be noted that because of the manner of their derivation the curves for each light source have different ordinate scales so that the relative magnitude between the curves is not significant, the proportion of the total light from each source which occurs at particular wavelength being the significant information provided by this graph.

The magnitude of the red erase light exposure on the photoconductor was selected to be about 200 ergs/cm$^2$, which in this example was about 10 times the imagewise exposure of 20 ergs/cm$^2$. The erase exposure with green and white light were of similar magnitude. The specific red light source utilized in the erase exposure of Example 1 was a General Electric warm/white WWX fluorescent lamp modulated with a Wratten 2A filter (-UV) and a Wratten 92 filter (-blue, green). Other red light sources could be utilized, e.g., a red phosphor lamp which would avoid filtering.

EXAMPLE 2

The 1500 cycle repetitive charge and expose test described in Example 1 was conducted again with respect to the same photoconductor, but in this instance only with a red erase light of spectral content described above, positioned at the front surface of the photoconductive film. The residual images that occurred were strong and positive appearing. This result in conjunction with Example 1 illustrates the desirability of locating the erase light in a position where it exposes the positively biased surface of the film.

EXAMPLE 3

Aggregate organic photoconductor films of the same general type described in Example 1 were each subjected to two regeneration tests, each test involving 500 charge and expose cycles. The first test used a front green light providing radiation in the range of 485 to 580 nm with a maxima at 525 nm as erase illumination and the second used two red rear erase lights providing radiation in the range of 625 to about 750 nm with a maxima at 660 nm.

In this experiment, the exposure light was directed onto the film through a modulated 630 IF filter instead of from a document, and measurements of electrostatic charge levels on the film at various stages of the tests were taken. An analysis of these tests indicated that erase exposure with two rear red lights led to improved film performance in the following respects:

1. The red-light erased films exhibited less loss in the ability to retain initial charge during the 500 cycles; i.e., the films erased with red light were chargeable to a higher initial potential during 500 cycles;
2. The red-light erased films exhibited less rise in the background charge level, i.e., charge remaining on exposed areas during 500 cycles;
3. The red-light erased films exhibited lower level of residual charge after erase illumination during 500 cycles; and
4. The red-light erased films exhibited less speed loss during 500 cycles.

The position along the film path of the sources 16 and 17 constitutes an additionally advantageous feature of the invention, in that field load on the portions of the imaging member corresponding to dark document areas is minimized by providing illumination to those portions as soon as the need for the electrostatic charge thereon terminates. Thus source 16 is located along the path immediately after the development station to relieve the high latent image potential after toning, the residual attractive forces being adequate to retain the toner image. Similarly source 17 is located in a position to provide erase illumination immediately after the imaging member is subjected to the transfer corona discharge field, thereby quickly relieving any potential induced on the imaging member during the transfer procedure.

From the foregoing it will be appreciated that the apparatus and techniques provided improved control of electrical memory effects in photoconductive insulating members in two ways, viz. minimizing the creation of trapped electrons by reducing the field load on the member and neutralizing trapped electrons, which do occur, in a more efficient manner. Although the examples given herein have been specific organic photoconductive films having peak absorption characteristics matching light of spectral quality in the red color range, it will be appreciated that the invention can be advantageously utilized with other types of photoconductor elements having peak absorption to light of other spectral quality.

The invention has been described in detail with particular reference to preferred embodiments thereof, but it will be understood that variations and modifications can be effected within the spirit and scope of the invention.

We claim:

1. In an electrophotographic apparatus of the type utilizing a reusable photoconductive insulative element extending over a conductive layer and mounted for repetitive movement around an operative path and including primary charging, exposure, development and transfer stations which perform copy producing operations on said element during its movement around said path in a manner creating negative and positive electrical bias on opposite surfaces of said element, an improved device for controlling electrical memory effects in such element, said device comprising a source of strongly absorbed electromagnetic radiation which is located along the operative path of movement of said element so as to direct radiation on the positively biased surface of such element during movement from said development station to said primary charging stations.

2. The invention defined in claim 1 wherein said source of radiation includes first means for providing such radiation on said surface at a first location closely subsequent, in the direction of copying travel of said element, to said development station and second means for providing such radiation on said surface at a second location closely subsequent, in the direction of copying travel of said element, to said transfer station.

3. The invention defined in claim 1 wherein said radiation source provides radiation having a substantial spectral content which is of wavelengths closely corresponding to the peak absorption wavelengths of said photoconductive insulative element.

4. The invention defined in claim 1 wherein said source provides radiation of spectral content such that at least 25% of its radiation incident on said positively biased surface of said element occurs at wavelengths to which said element's optical density is no less than about 50% of said element's maximum optical density.

5. The invention defined in claim 1 wherein said photoconductive insulative element comprises a multiple phase aggregate photoconductor composition including a continuous electrically insulating binder phase having dispersed therein a particulate co-crystalline complex of pyrylium type dye salt and a polymer having an alkylidene diarylene moiety in recurring unit and said radiation comprises substantially entirely wavelengths within the range from about 625 nm to 750 nm.

6. An improved electrophotographic apparatus of the type having primary charging, exposure, development and transfer stations for repetitively producing copies with a reusable imaging element, including an organic photoconductive layer and underlying conductive layer, which is moved therepast cyclically and which develops negatively and positively biased surfaces during use, said apparatus including a device for regenerating the electrophotosensitive properties of said photoconductive layer which comprises:

means for directing electromagnetic energy consisting of radiation strongly absorbed by said photoconductor onto the positively biased surface of said photoconductive layer during at least one portion of the period of its operative cycle from said development station to said primary charging station.

7. The invention defined in claim 6 wherein said energy directing means includes first means for providing such strongly absorbed radiation on said positively biased surface at a first location closely subsequent, in the direction of copy producing travel of said element, to said development station and second means for providing such radiation on said surface at a second location closely subsequent, in the direction of copy producing travel of said element, to said transfer station.

8. The invention defined in claim 6 wherein said conductive layer is substantially transparent to said strongly absorbed radiation and said radiation is directed to said positively biased surface through said conductive layer.

9. An improved electrophotographic apparatus of the type having primary charging, exposure, development and transfer stations for repetitively producing copies on a reusable imaging member which includes an organic photoconductive layer and substantially transparent underlying conductive layer, and in which a negative and positive bias are developed respectively on the front and rear surface of said photoconductive layer surfaces during its use, said apparatus including a device for regenerating the electrophotosensitive properties of said photoconductive layer which comprises:

an energizable source of radiation having a substantial portion of its spectral content of wavelengths highly absorbed by said photoconductive layer and having at least 25% of its incident energy on the surface of the photoconductive layer at wavelengths to which the imaging member's net optical density is no less than about 50% of the maximum net optical density of said imaging member, said source being constructed and located for directing such radiation through said conductive layer onto the rear positively biased surface of said photoconductive layer at a position along its operative travel path from said development station to said primary charging station.

10. The invention defined in claim 9 wherein said source of radiation includes first means for providing such radiation on said rear photoconductive surface at a first location closely subsequent, in the direction of copying travel of said imaging member, to said development station and second means for providing such radiation on said rear photoconductive surface at a second location closely subsequent, in the direction of copying travel of said imaging member, to said transfer station.

11. In electrophotographic apparatus of the type having primary charging, exposure, development and transfer stations for repetitively producing copies with a reusable organic photoconductor during movement past said stations and which develops negatively and positively biased surfaces on said photoconductor during copying use, improved means for regenerating the electrophotosensitive properties of said photoconductor, said regenerating means comprising an energizable source of radiation having a major portion of its spectral content of wavelengths highly absorbed by said photoconductor and having at least 25% of its radiation incident on said photoconductor occurring at wavelengths to which said photoconductor's optical density is no less than approximately 50% of said photoconductor's maximum net optical density, said source being constructed and located in said apparatus for providing such radiation on the positively biased surface of said photoconductor at at least one position on its path of copy travel from said development station to said primary charging station.

12. The invention defined in claim 11 wherein said source of radiation includes first means for providing such radiation on said positively biased surface at a first location closely subsequent, in the direction of copying travel of said photoconductor, to said development station and second means for providing such radiation on said positively biased surface at a second location closely subsequent, in the direction of copying travel of said photoconductor, to said transfer station.

13. The invention defined in claim 12 wherein said photoconductor comprises a multiple phase aggregate photoconductor composition including a continuous electrically insulating binder phase having dispersed therein a particulate cocrystalline complex of pyrylium type dye salt and a polymer having an alkylidene diarylene moiety in recurring unit and said radiation comprises substantially entirely wavelengths within the range from about 625 nm to 750 nm.

* * * * *